US005664440A

United States Patent [19]

Roemer

[11] Patent Number: 5,664,440

[45] Date of Patent: Sep. 9, 1997

[54] ENHANCED DIAMOND RING

[76] Inventor: Thomas Bruce Roemer, 1163 First Capitol Dr., St. Charles, Mo. 63301

[21] Appl. No.: 658,319

[22] Filed: Jun. 5, 1996

[51] Int. Cl.[6] ..... A44C 9/00

[52] U.S. Cl. ..... 63/15; 63/26; 63/28

[58] Field of Search ..... 63/26, 27, 28, 63/29.1, 30, 31, 32, 15

[56] References Cited

U.S. PATENT DOCUMENTS

| | | |
|---|---|---|
| 286,023 | 10/1883 | Lancon . |
| 1,131,593 | 3/1915 | Bashor . |
| 1,308,011 | 6/1919 | Gilsey . |
| 1,377,130 | 5/1921 | Hashimoto . |
| 1,730,257 | 10/1929 | Welch . |
| 1,912,602 | 6/1933 | Stonberg . |
| 2,261,958 | 11/1941 | Burri . |
| 2,447,407 | 8/1948 | Grain . |
| 3,528,261 | 9/1970 | Jones . |
| 3,808,836 | 5/1974 | Jones . |
| 3,835,665 | 9/1974 | Kitchel . |
| 3,897,529 | 7/1975 | Carr et al. . |
| 4,809,417 | 3/1989 | Normann, Jr. . |
| 4,878,364 | 11/1989 | Freihich ..... 63/28 |
| 4,942,744 | 7/1990 | Wei . |
| 5,090,216 | 2/1992 | Waugh . |
| 5,454,234 | 10/1995 | Karmeli . |

*Primary Examiner*—Kien T. Nguyen

*Attorney, Agent, or Firm*—Polster, Lieder, Woodruff & Lucchesi, L.C.

[57] ABSTRACT

A composite ring having a setting with a colored inner gemstone and a diamond outer stone with the color generated by light passing through the inner stone being visible when the diamond is viewed.

11 Claims, 1 Drawing Sheet

ENHANCED DIAMOND RING

BACKGROUND OF THE INVENTION

This invention relates to the ring art and specifically to a diamond ring setting in which the color and brilliance of the diamond is enhanced by a second colored precious stone positioned beneath the diamond in the sitting to give a color tint to the diamond based on the color of the secondary stone.

The preferred secondary stone is a sapphire to give a blue tint to the diamond. An emerald will give a green tint to the diamond. Other stones which can be used include ruby, tanzanite, topaz, tourmaline, lapis, opal, amethyst, etc. The desired color determines the type of stone used.

It is known to form a cavity in a large stone and place smaller stones inside of the cavity, after which the larger stone is secured together. This is shown in U.S. Pat. No. 5,454,234. U.S. Pat. No. 5,090,216 shows forming a seat in a semiprecious gem and cementing a precious stone in the seat. Other patents which form a cavity in a stone and place objects inside the cavity to enhance the brilliance of the stone are U.S. Pat. Nos. 4,942,744 and 2,447,407.

In my invention, the colored stone is positioned in the setting with a diamond positioned immediately above, but spaced from the colored stone, in the same setting.

BRIEF DESCRIPTION OF THE DRAWINGS

In the drawings where like numbers refer to like parts wherever they occur.

DETAILED DESCRIPTION

Figure 1:
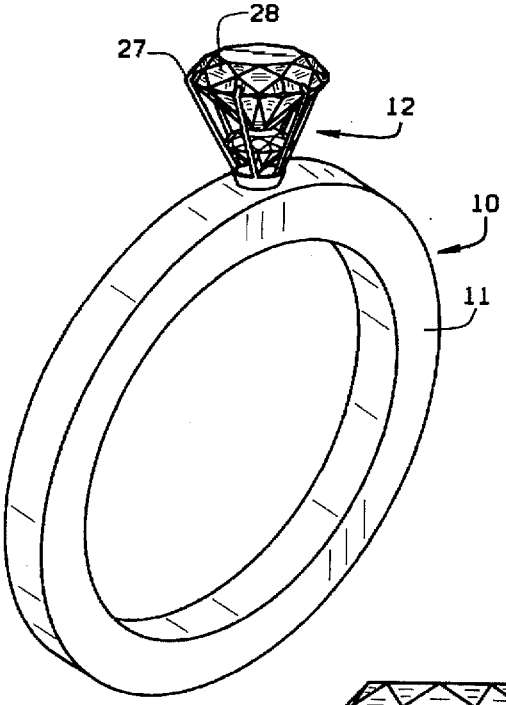
FIG. 1 is a perspective view of my new ring setting.
Figure 2:
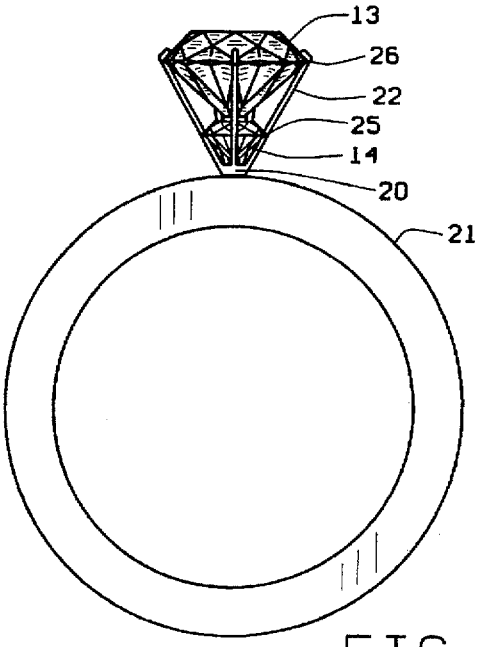
FIG. 2 is a front elevational view of my ring setting.
Figure 3:
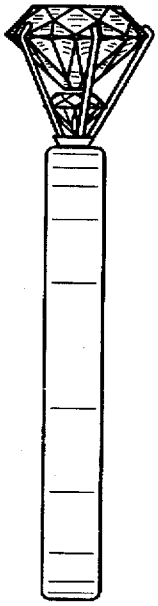
FIG. 3 is a side elevational view of my ring setting.

FIGS. 1–3 show the present invention embodied in a ring 10. The ring 10 includes a finger encircling portion 11 and a stone setting 12. The setting shown in FIGS. 1–3 includes a brilliant cut diamond 13 and a similarly brilliant cut sapphire 14 immediately beneath the diamond 13.

Figure 4:
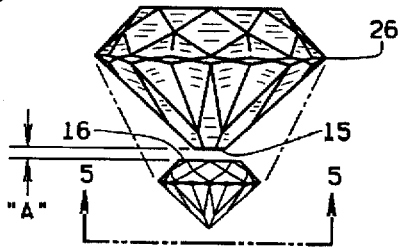
FIG. 4 is an enlarged side view of the stone portion of my invention.

It is important that the culet 15 of the diamond 13 be very close to but still spaced apart from the table 16 of the sapphire 14. The preferred spacing is from about 0.1–2 mm. as shown by the distance "A" in FIG. 4.

In the ring 10 illustrated in FIGS. 1–3, a base 20 is soldered on the outer surface 21 of the shank or finger band 11 and a series of spaced retaining arms 22 extend in a diverging pattern outwardly from the base 20. The arms 22 retain the gems 13 and 14 on the ring 10.

The retention means can vary, but as shown in FIGS. 1–3 and 6, the arms 22 are provided with spaced notches 23, 24. The innermost set of notches 23 engage the girdle 25 of the sapphire 14. The outermost set of notches 24 engage the girdle 26 of the diamond 13. The outermost ends 27 of the arm 22 are laid over the facets 28 of the diamond 13.

Figure 6:
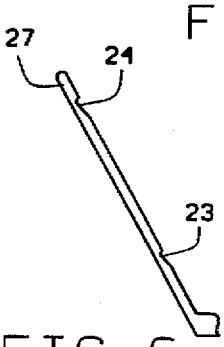
FIG. 6 is a fragmentary side elevational view of a gem retaining arm.

FIG. 6 shows a modified form of setting 35 in which the finger band 36 has an enlarged top portion 37 which has a recess 38 formed therein to hold the sapphire 14. Upstanding arms 39 are formed in the top portion 37 and have recesses 40 spaced inwardly from the arm ends 41 to retain the diamond 13. The top ends 41 terminate approximately on the same plane as the table 42 of the diamond 13. This provides protection for the diamond 13 and prevents it from striking objects which could cause it to chip or become dislodged from the arms 39.

Figure 5:
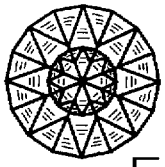
FIG. 5 is a bottom view taken along line 5—5 of FIG. 4.
Figure 5A:
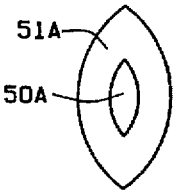
FIGS. 5A–5E are bottom views similar to that shown in FIG. 5, but showing different shapes of stones.
Figure 5B:
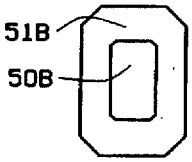
Figure 5C:
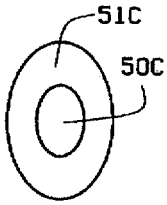
Figure 5D:
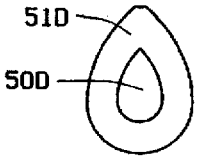
Figure 5E:
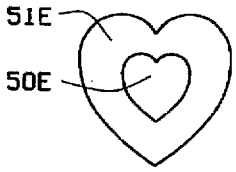

FIGS. 5A–5E are bottom views similar to FIG. 5 but showing different shapes of gems in the rings. FIG. 5A is a marquise cut stone. Both the sapphire 50A and the diamond 51A are marquise cuts. FIG. 5B is a rectangular cut and as before both the sapphire 50B and the diamond 51B are rectangular cuts. FIG. 5C illustrates oval cut gems 50C and 51C. FIG. 5D illustrates pear shaped gems 50D and 51D. FIG. 5E has heart shaped stones 50E and 51E. Other conventional types of cuts can be used including square cut, emerald cut, and cabochon cut, etc.

Figure 7:
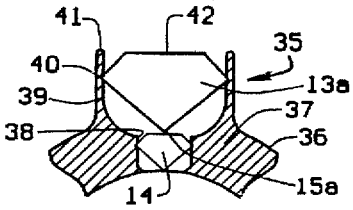
FIG. 7 is a fragmentary partial sectional view of a modification of my invention.

FIG. 7 shows a modification of the invention. In this form of the invention, the culet **15*a* of the diamond 13*a* comes to a point, rather than being a planar surface as shown in FIGS. 1–6**.

Various stones can be substituted for the sapphire, depending on the tint or hue one wants to give to the diamond. For example, an emerald will give a green cast to the diamond, a ruby will give a red or pink cast to the diamond, etc. Other suitable stones include tanzanite, topaz, tourmaline, lapis, opal, amethyst, etc. The colored stone also does not have to be faceted. However, it is preferred that the colored stone be of the same shape and cut as the diamond.

This invention is intended to cover all changes and modifications of the example of the invention herein chosen for the purposes of the disclosure which do not constitute departures from the spirit and scope of the invention.

What is claimed is:

1. A composite ring comprising a circular band capable of encircling the finger of a wearer, a setting positioned on the outer surface of the band and projecting away from the finger of the user, a pair of gem stones secured in the setting, the stones being juxtaposed, the outer most stone being a diamond and the inner most stone being a colored stone, the culet of the diamond being closely adjacent, but spaced from the table of the innermost stone, the color generated by the innermost stone being visible when the diamond is viewed.

2. The ring of claim 1 wherein the innermost stone is a sapphire and the color viewed through the diamond is bluish.

3. The ring of claim 1 wherein the distance between the culet of the diamond and the table of the inner stone is between 0.1–2 mm.

4. The ring of claim 1 wherein the culet of the diamond is a point.

5. The ring of claim 1 wherein the culet of the diamond is flat.

6. The ring of claim 1 wherein the band has an opening therethrough positioned beneath the setting and the colored stone is secured in the opening.

7. The ring of claim 1 wherein the setting includes upwardly extending arms having notches which engage the diamond at its girdle.

8. The ring of claim 7 wherein the arms have outer ends which engage the facets of the diamond adjacent to the girdle.

9. The ring of claim 8 wherein the arms are diverging from the band and having a second set of notches spaced inwardly from the notches which engage the diamond and the girdle of the inner stone is engaged by the second notches.

10. The ring of claim 7 wherein the arms are substantially perpendicular to the band and have outer ends which terminate at about the same height as the table of the diamond to protect the diamond.

11. The ring of claim 1 wherein the diamond and the second stone are round cut.

* * * * *